US006966792B1

(12) United States Patent
Willers et al.

(10) Patent No.: US 6,966,792 B1
(45) Date of Patent: Nov. 22, 2005

(54) METHOD AND APPARATUS FOR RETAINING A DETACHABLE CORD

(75) Inventors: Arthur G. Willers, Delran, NJ (US); Robert Pellegrino, Holland, PA (US)

(73) Assignee: Computer Network Technology Corp., Minneapolis, MN (US)

( * ) Notice: Subject to any disclaimer, the term of this patent is extended or adjusted under 35 U.S.C. 154(b) by 0 days.

(21) Appl. No.: 10/873,706

(22) Filed: Jun. 21, 2004

(51) Int. Cl.[7] ..... H01R 13/62
(52) U.S. Cl. ..... 439/373; 439/441
(58) Field of Search ..... 439/373, 369, 439/135, 140, 147, 441

(56) References Cited

U.S. PATENT DOCUMENTS 2,761,112 A * 8/1956 Torcivia ..... 439/147
3,428,936 A * 2/1969 Arnao, Jr. ..... 439/144
4,143,934 A 3/1979 Siebert
5,472,355 A * 12/1995 Wittmann ..... 439/373
5,575,677 A 11/1996 Buckner et al.
5,928,023 A 7/1999 Buckner et al.
6,080,008 A * 6/2000 Frantz ..... 439/441
6,276,952 B1 * 8/2001 Ferranti et al. ..... 439/345
6,309,239 B1 * 10/2001 Johnston ..... 439/373
6,443,762 B1 9/2002 Lessig
6,491,539 B1 12/2002 Johnston
6,699,060 B1 * 3/2004 Scott ..... 439/373

* cited by examiner

*Primary Examiner*—Tho D. Ta
(74) *Attorney, Agent, or Firm*—Beck & Tysver, P.L.L.C.

(57) ABSTRACT

A method and apparatus for retaining a detachable cord is shown that includes two retainer halves of substantially identical proportion and construction. The retainer halves are compressed together around a detachable power cord, and are attached about the power outlet of an electronic device. The retainer halves include an anti-pullout tab that protrudes inward towards to the power cord plug to assist in retaining the cord.

27 Claims, 3 Drawing Sheets

METHOD AND APPARATUS FOR RETAINING A DETACHABLE CORD

FIELD OF THE INVENTION

The invention presented in this application pertains generally to cord retainers. More particularly, the present invention relates to retaining a detachable cord plugged into a power outlet of an electronic device.

BACKGROUND OF THE INVENTION

The purpose of a power cord is to make and maintain an electrical connection between a power source and a device. In doing so, power necessary to operate the device is provided. In most cases, the cord can be easily removed from the power outlet. In the case of computer equipment, the power cord is often made removable from the equipment as well. The obvious problem with the use of removable power cords is the accidental removal of the cord from either the equipment or the outlet causing the equipment to shut down.

One solution to this problem is to place the cords in locations that reduce the possibility that they will be accidentally removed, such as by running the power cord under the flooring that carries pedestrian traffic. While this is helpful, sub-floor wiring is still subject to accidental forces, such as when other sub-floor wires are accessed for installation or maintenance. A similar solution involves placing a conduit on top of the floor so as to prevent someone from accidentally tripping over the cord. Unfortunately, conduits are not usually fixed to the floor and can be moved, which may cause the cord to pull out from either the equipment or the power source.

When a cord cannot be buried or hidden, it is more likely that it would be accidentally disconnected. This can be disastrous when the equipment is an essential computer or networking device, because vital computer services can or will be lost when the cord is disconnected.

A common solution to this problem is to secure the cord with an integrated fastener. This approach is more prevalent on data cables then on electrical supply cords. For example, the data cables between computers and peripherals often utilize screws or other attachment devices integrated into the plug. When the plug is attached to a computing device, the attachment mechanisms in the plug can be secured into mating receptacles on the device. One problem with this solution is that these cords are very specific. In other words, the device receptacle and the cable plug must be of such a design that the electrical connection and mechanical retention features line up and mate perfectly with one another. New cords with the latest attachment mechanism may not match with older equipment, and vice versa.

Accordingly, it is desirable to provide a method and apparatus that allows a technician to fasten and secure a power cord efficiently and effectively regardless of variations in the external size and shape of the power cord plug. In addition, it is desirable to provide an apparatus that allows the technician to connect and secure a cable without the need for any specialized tools.

SUMMARY OF THE INVENTION

The foregoing needs are met, to a great extent, by the retainer invention presented in this document. The retainer consists of two halves, and is designed to hold a cord in place even when the cord is subjected to an extraction force.

The primary advantage of the present invention is that the retainer need not be matched to a cable or plug, since it is adjustable and effectively retains a variety of shaped plugs.

This is accomplished using a retainer of a unique two-piece design. Each half of the retainer is to be secured on opposing sides of a receptacle on an electronic device. The retainer's securing mechanism that mounts to the device allows each half of the retainer to move either toward or away from its opposing half, thus making the space between the retainer halves easily adjustable.

When a power cord is plugged into the receptacle, the plug of the cord is located between the two parts or halves of the retainer. The retainer halves are then pulled together. In the preferred embodiment, this is accomplished through two adjustment screws. The retainer's connection mechanism allows the two halves to tighten closely around the power cord plug while accommodating variations in plug size. An anti-pullout tab in each half of the retainer then contacts the plug and resists any extraction forces that are applied to the cord.

In the preferred embodiment, the two retainer halves are made identically, so as to be interchangeable with each other. A base flange formed in each half allows the attachment of the retainer to the surface of a device. Attachment of the retainer halves to the device is made by inserting a screw through a slot in the base flange of each half of the retainer, and mounting it to the device to be powered. The retainer halves may be held in place and yet be moved a short distance with respect to one another to accommodate different size plugs or to insert or remove a plug.

Each retainer half extends around the sides of a power cord and connects with its mating half by means of two flanges. The two halves are held together in their intended position using a simple clearance hole in one flange, and a threaded hole in the other flange. This allows two screws to secure the two retainer halves together. Each screw passes through the clearance hole of one retainer half to the threaded hole of the second half. By tightening these screws, the two retainer halves are tightened around the plug. An anti-pullout tab is located at the center of each retainer half. This tab protrudes inward toward the power cord plug and secures the plug when the two retainer halves are tightened. The angle at which the tab engages with the power cord plug provides an important role in resisting any extraction force on the cord.

The present invention also includes a method for securing a detachable cord. This method includes positioning one retainer half around a first side of the detachable cord and a second retainer half around the opposite side of the cord. The two retainers are attached to each other and tightened, so as to prevent movement of the cord. One or both of the retainers are attached to a device or other surface to prevent the extraction of the cord. This method can further include adjusting the width of the structure by moving the two retainer sections with respect to one another.

DETAILED DESCRIPTION OF THE INVENTION

Figure 1:
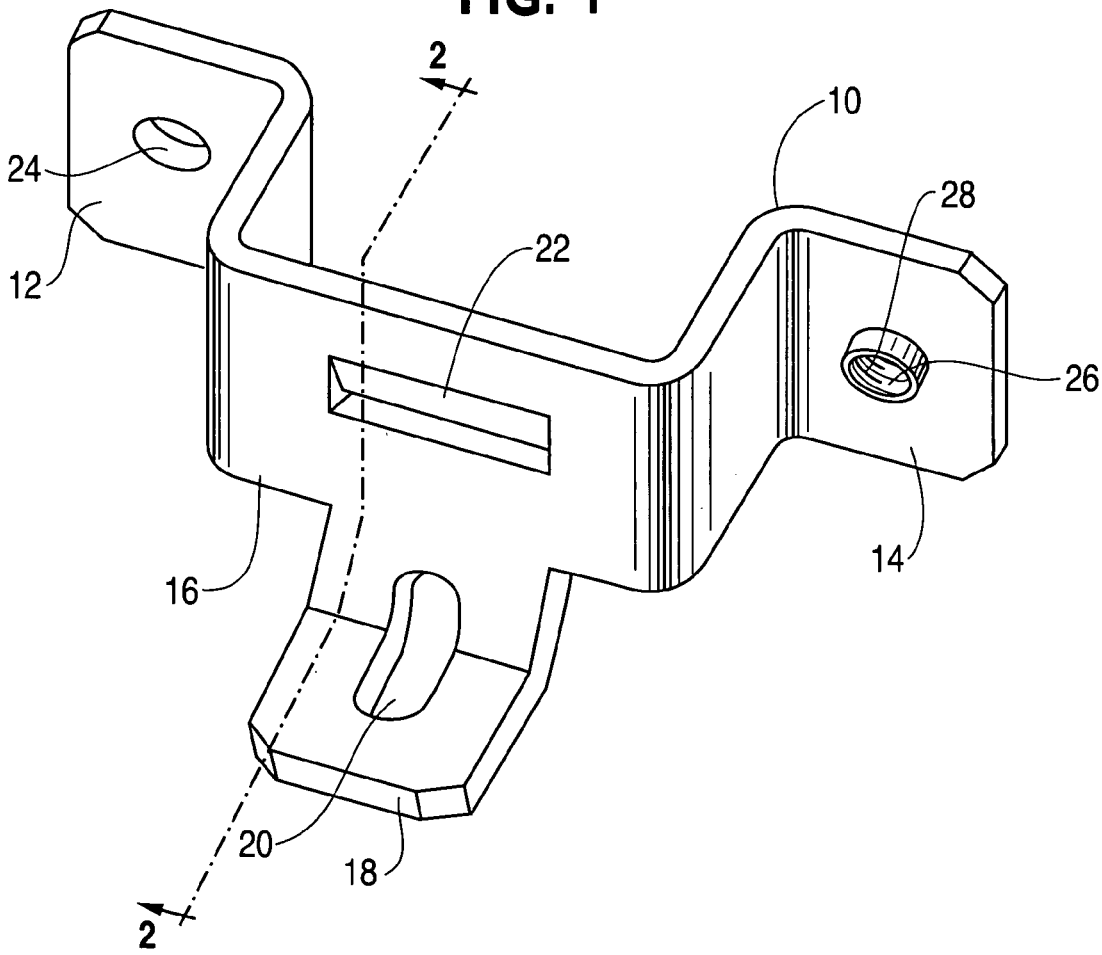
FIG. 1 is an isometric view illustrating a retainer piece or half according to a preferred embodiment of the present invention.

The preferred embodiment of the present invention is illustrated in FIG. 1, which shows a single retainer half or piece 10. Since the retainer invention uses two identical halves, it is only necessary to define one such half as shown in FIG. 1. The retainer half 10 includes a clearance hole mounting flange 12 and a similar threaded hole mounting flange 14. The retainer half 10 also includes a U-shaped interior mid section 16 that connects the two flanges 12, 14.

In the case of power cords traditionally used in the electronics industry, the plug end of the detachable cord is generally square or rectangular in shape. However, it is well within the scope of this invention to restrain plugs of other shapes. The U-shape of the mid section 16 will allow the retainer invention to be used with a great variety of plug shapes. The present invention is not limited to the U-shape, as other concave configurations of the mid section 16 would also be effective. Although a non-concave mid section 16 might be effective in retaining a power cord, it would not be preferred.

The retainer half 10 includes a bracket or base flange 18 for attaching to a device. The retainer's base flange 18 contains a slot 20 to accept a fastener, which is used to secure the retainer half 10 to an electronic device or to a wall or other surface.

The retainer half 10 also includes an anti-pullout tab 22 that protrudes from the mid section 16. This feature is formed from a portion of the mid section 16 and is angled inwards towards the detachable cord. This feature provides an important role in the retention of the power cord because it grips the cord's plug snugly while opposing the forces necessary to pull the cord out. This is all possible without causing damage the cord material.

The first and second flanges 12, 14 each contain a hole 24, 26, respectively. These holes 24, 26 are used to attach one retainer half 10 to a second identical retainer half by means of two screws. When two halves of the apparatus are brought together, the through or clearance hole 24 in the flange of the first half lines up with the threaded portion 28 in the flange of the second half thus making it possible to join the halves together with screws.

The retainer half 10 is made from 16 gauge cold rolled steel sheet stock with a half hard temper, preferably AISI (American Iron & Steel Institute) 1008 or 1010. For cost savings and ease of manufacture, the entire part is designed to be punched in the flat by means of a standard NC turret punching machine, including the anti-pullout tab 22, slot and holes 20, 24 and 26. Then, the flanges 12, 14, mid section 16, and base flange 18 are formed using a standard brake. Afterwards, the part is to receive a black zinc and clear chromate finish and a self-clinching, preferably self-locking, threaded fastener 28 is to be installed into flange 14. The versatility of the invention's design is such that should demand require a high volume of production quantity, the entire part could be punched and formed by means of the progressive die method. The advantage of this option of manufacture is a high volume, high quality part at a low cost per each half.

The anti-pullout feature 22 is preferably a three-sided truncated rectangle formed from out of the mid section 16 by punching three-sides of the rectangle and bending the resulting feature into the area defined by the U-shaped mid section 16. Alternatively, the anti-pullout tab 22 could be formed in a single hit using a custom turret punch at a minimal cost. Under either circumstance, the simplicity of the invention's design minimizes manufacturing costs.

Another way that manufacturing costs are reduced is by the use of two identical retainer halves 10 to form a completed retainer assembly. Though the invention could be made with two halves 10 of differing configurations, the cost of manufacture would increase because each half would be manufactured differently. This is especially true if the progressive die method of manufacture is used.

Figure 2:
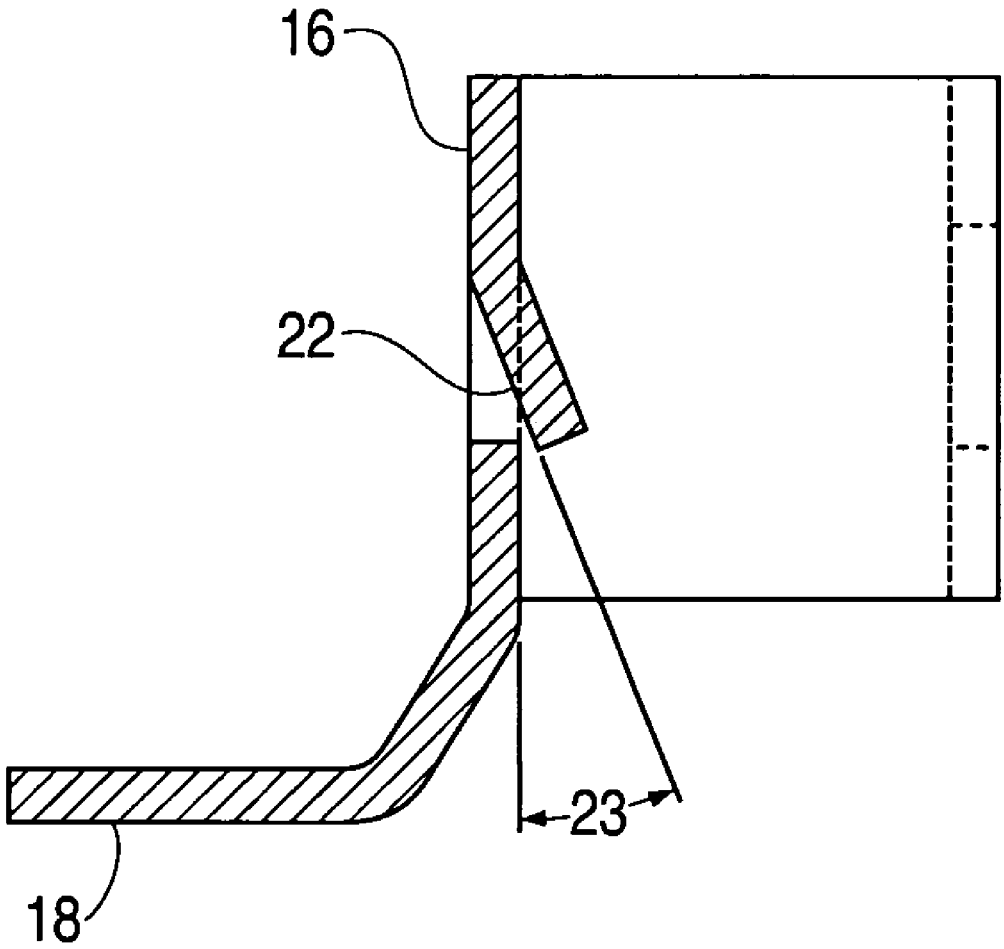
FIG. 2 is a cross-sectional view of the retainer half shown in FIG. 1 as it is divided along cut line 2—2.

In FIG. 2, the cross-sectional view of retainer half 10 shows the construction of the anti-pullout tab 22 in more detail. The angle 23 of the tab 22 with respect to the rest of the mid section 16 is by design the smallest angle necessary to retain the plug while under a significant extraction force. In the preferred embodiment, the tab 22 is deflected at an angle 23 of twenty degrees from the mid section 16. As previously noted, by having the anti-pullout tab 22 open inward towards the power cord plug, the forces necessary to extract the plug are resisted thus maintaining the position of the plug. The design of the retainer allows the option of increasing the angle of the anti-pullout tab 22 in order to accommodate future variants in plug size designs.

Figure 3:
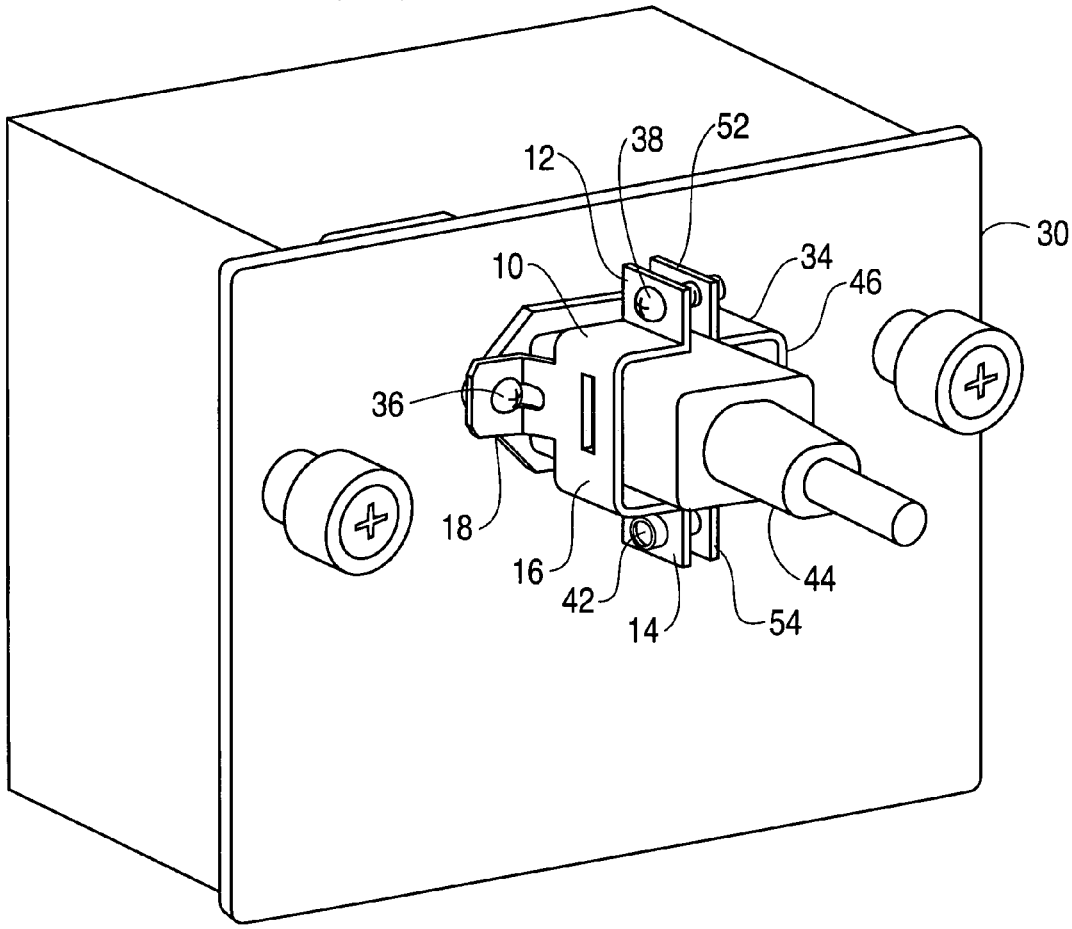
FIG. 3 is an isometric view illustrating a complete retainer assembly consisting of two of the halves shown in FIG. 1 retaining a power cord.

FIG. 3 shows two identical retainer halves 10, 34 being used together to hold a cord 44 in place and connected to an electrical device 30. The two U-shaped mid sections 16, 46 surround the cord 44 and tightly hold it in place.

The method of installation to restrain a cord 44 using the present invention is flexible. For example, the cord 44 can first be connected into the electrical device 30 and then the two retainer halves 10, 34 can be placed about the plug of cord 44 and mounted to the device 30 by means of screws 36 fastened through the base flanges 18 of the retainer. Preferably, the mounting screws 36 are self-clinching, such as a self-locking, 6-32 UNC 2B fastener. The two haves of the retainer 10, 34 are then secured by two screws 38, 42 fastened through the holes provided in flanges 12, 14, 52 and 54. The screws 38, 42 then compress the retainer pieces 10, 34 against the plug of cord 44. Similarly, the retainer invention can be mounted loosely to the electrical device 30 first, in accordance to the procedure defined above, and then the power cord plug 44 can be installed and the entire assembly tightened up. Since screw 36 is mounted through a slot 20 rather than a simple round hole, the retainer halves 10, 34 can be moved with respect to one another by positioning the halves 10, 34 along the travel provided by the slots without fully detaching the halves 10, 34 from the electronic device 30.

The invention is not to be taken as limited to all of the above details, as modifications and variations may be made without departing from the intent or scope of the invention. As such, those skilled in the art will appreciate that the conception upon which this disclosure is based and may readily be utilized as a basis for designing future electronic products that incorporate the methods, systems and purposes of the present invention. For example, the preferred embodiment uses screws 36, 38, and 42 as the mechanical fasteners that connect and secure the components of the invention. Other attachment and compression mechanisms would be well-known to those of skill in the art, including as bolts, retaining clips, and the like. Consequently, the invention should not be limited by the specifics of the above description, but rather should be limited only by the following claims and equivalent constructions.

What is claimed is:

1. An apparatus for retaining a detachable cord to a surface comprising:

a) a first and second retainer half, each having a first flange and a base flange having portions forming a slot;

b) a first attachment mechanism connected to the first flange of the first retainer half and to the first flange of the second retainer half, the attachment mechanism further securing the detachable cord between the first and second retainer halves by compressing a portion of the detachable cord between the first and second retainer halves; and c) a second attachment mechanism having a first and second connector passing through the slots of the base flanges, the second attachment mechanism securely connecting the first and second retainer halves to the surface, wherein the retainer halves can be moved with respect to one another by positioning the connectors in differing positions in the slots.

2. The apparatus of claim 1, wherein the connectors are threaded connectors.

3. The apparatus of claim 1, wherein first attachment mechanism comprises a means for attaching the retainer halves together.

4. The apparatus of claim 1, wherein the first and second retainer halves both have a second flange, wherein a third attachment mechanism is connected to the second flange of the first retainer half and to the second flange of the second retainer half.

5. The apparatus of claim 1, wherein the retainer halves each have an anti-pullout tab extending into the cord while angled toward the surface to assist in retaining the cord.

6. The apparatus of claim 1, wherein the first attachment mechanism comprises a threaded connector passing through a hole in the first flange of the first retainer half and passing through a hole in the first flange of the second retainer half.

7. The apparatus of claim 6, wherein the threaded connector is chosen from a set of threaded connector comprising a bolt secured by a nut, and a screw secured by a thread located in the hole of the first flange of the first retainer.

8. The apparatus of claim 1, wherein the first and second retainer halves both have a concave-shaped mid section, wherein the cord is retained within the concave-shaped mid sections of the retainer halves.

9. The apparatus of claim 8, wherein concave-shaped mid sections are substantially u-shaped and are configured to match a plug portion of the cord.

10. The apparatus of claim 8, wherein the concave-shaped mid sections of the first and second retainer halves both have an anti-pullout tab protruding from the mid sections toward the cord to assist in retaining the cord.

11. An apparatus for retaining a detachable cord to a surface comprising:

a) a first and second retainer halves, both retainer halves being substantially identical, each retainer half having i) a first and second flange, ii) a bracket, iii) a mid section, with the detachable cord being retained within an area bounded by the mid sections of the first and second retainer halves, and iv) an anti-pullout tab protruding from the mid sections toward the cord, b) a first attachment mechanism connected to the first flange of the first retainer half and to the second flange of the second retainer half, c) a second attachment mechanism connected to the second flange of the first retainer half and to the first flange of the second retainer half, d) a third attachment mechanism connected to at least one of the brackets and to the surface, thereby securing the retainer halves to the surface.

12. The apparatus of claim 11, wherein the mid sections of the retainer halves are substantially u-shaped.

13. The apparatus of claim 11, wherein the retainer halves are formed out of a single half of rigid material having a generally uniform thickness.

14. The apparatus of claim 13, wherein the tab is cut out of the mid section on three sides and is angled toward the detachable cord.

15. The apparatus of claim 14, where the angle between the mid section and the tab is approximate twenty degrees.

16. An apparatus for a securing a detachable, insulated power cord to a surface, comprising:

a) a first and second retainer means for retaining the detachable cord;

b) a compressing means for compressing the retainer means toward each other so as to retain the detachable cord between the retainer means; and c) an attachment means for attaching one of the first and second retainer means to the surface; and d) an anti-pullout tab extending from one of the first and second retainer means into the detachable cord without causing damage to the cord.

17. The system as in claim 16, wherein the anti-pullout tab extending from one of the first and second retainer means into the detachable cord is formed from half hard temper steel.

18. An apparatus for retaining a detachable cord to a surface comprising:

a) a first and second retainer half of identical construction, each having i) a clearance hole mounting flange having a clearance hole, ii) a threaded hole mounting flange having a threaded hole, and iii) a base mounting flange for attaching to the surface of an electronic device; and b) two screws mounted through the holes in the retainer halves, such that when two identical retainer halves are brought together around the detachable cord, the clearance hole flange of the first half aligns with the threaded hole flange of the second half, and the clearance hole flange of the second half aligns with the threaded hole flange of the first half, with a plug from the detachable cord being compressed between the two retainer halves.

19. The apparatus of claim 18, wherein the base mounting flange includes a central slot, and further comprising mounting hardware with a threaded portion and a head portion, with the threaded portion of mounting hardware passing through the slot and the head of the hardware to bear against the mounting flange, thus allowing the retainer halves to be moved with respect to one another by positioning the halves along the travel provided by the slots without becoming detached from the electronic device.

20. The apparatus of claim 19, wherein the threaded portion of the mounting hardware is a self-locking, 6-32 UNC 2B fastener.

21. The apparatus of claim 18, wherein each retainer half further comprises a central U-shaped portion containing an anti-pullout tab protruding at an angle from the remainder of the U-shaped portion.

22. The apparatus of claim 21, wherein the angle of the anti-pullout tab is twenty degrees.

23. The apparatus of claim 21, wherein each retainer half is made from a cold rolled steel sheet with the holes and anti-pullout tab punched by a punching machine, and the flanges formed by a standard brake.

24. A method for securing a cord to a surface comprising:

a) attaching a first retainer half to the surface b) attaching a second retainer half to the surface;

c) after attaching the first and second retainer halves to the surface, connecting the first retainer half to the second retainer half;

d) after attaching the first and second retainer halves to the surface, positioning the cord between the first and second retainer halves; and e) after steps a–d, compressing the retainer halves together into contact with the cord with sufficient force so as to resist the cord being pulled out from between the first and second retainer halves.

25. The method of claim 24, wherein the step of compressing the retainer halves together further comprises the step of compressing an anti-pullout tab found on one of the retainer halves into the cord.

26. The method of claim 24, wherein the retainer halves are compressed into contact with a plug portion of the cord.

27. The method of claim 24, wherein the first and second retainer halves are of identical construction.

* * * * *